United States Patent [19]

Cousin

[11] 4,269,275

[45] May 26, 1981

[54] REPLACEABLE EDGE BIT ASSEMBLY

[76] Inventor: Lucien Cousin, 749 Stirling St., Labrador City, Canada, A2V 1Y9

[21] Appl. No.: 60,157

[22] Filed: Jul. 24, 1979

[30] Foreign Application Priority Data

Sep. 26, 1978 [CA] Canada ..... 312123

[51] Int. Cl.[3] ..... E02F 3/76

[52] U.S. Cl. ..... 172/719; 37/141 R

[58] Field of Search ..... 172/719, 803, 277, 807, 172/753, 727, 430, 276; 37/2 R, 98, 141 R, 142 R, 141 T

[56] References Cited

U.S. PATENT DOCUMENTS

| | | | |
|---|---|---|---|
| 2,105,320 | 1/1938 | Heil | 37/141 T |
| 2,285,039 | 6/1942 | Lowe | 37/141 R |
| 2,482,320 | 9/1949 | Clemmer | 37/141 R |
| 2,554,505 | 5/1951 | Schneider | 172/803 |
| 3,091,044 | 5/1963 | Penote | 37/142 R |
| 3,158,944 | 12/1964 | Rehberg | 172/803 |
| 3,845,578 | 11/1974 | Holmstrom | 37/141 R |
| 3,995,384 | 12/1976 | Wood | 37/141 R |

FOREIGN PATENT DOCUMENTS

| | | | |
|---|---|---|---|
| 819012 | 7/1969 | Canada | 37/141 R |

*Primary Examiner*—Richard J. Johnson

[57] ABSTRACT

A replaceable edge bit assembly for use on the mold board of an earth-working implement is disclosed. The bit assembly comprises a bit having a front portion adapted to engage the lower front edge of the mold board, and a rear portion adapted to engage the lower rear edge of the mold board, a wear plate secured to the edge of the front portion of the bit, a skid shoe secured underneath the rear portion of the bit, and a bracket for securing the bit to the mold board.

2 Claims, 6 Drawing Figures

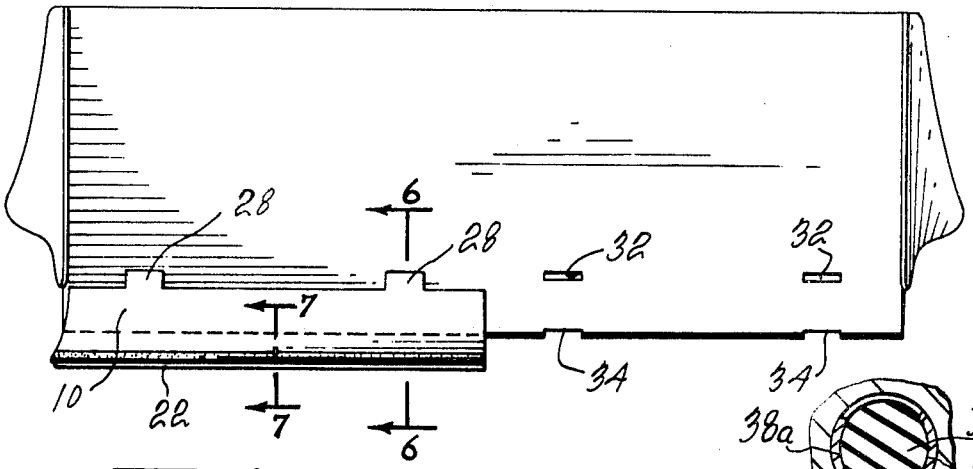
Fig-4
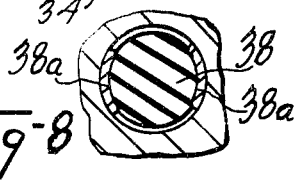
Fig-8
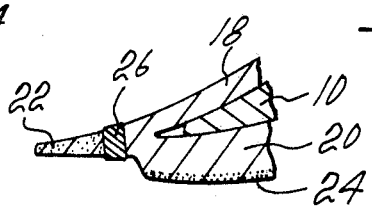
Fig-7
Fig-6
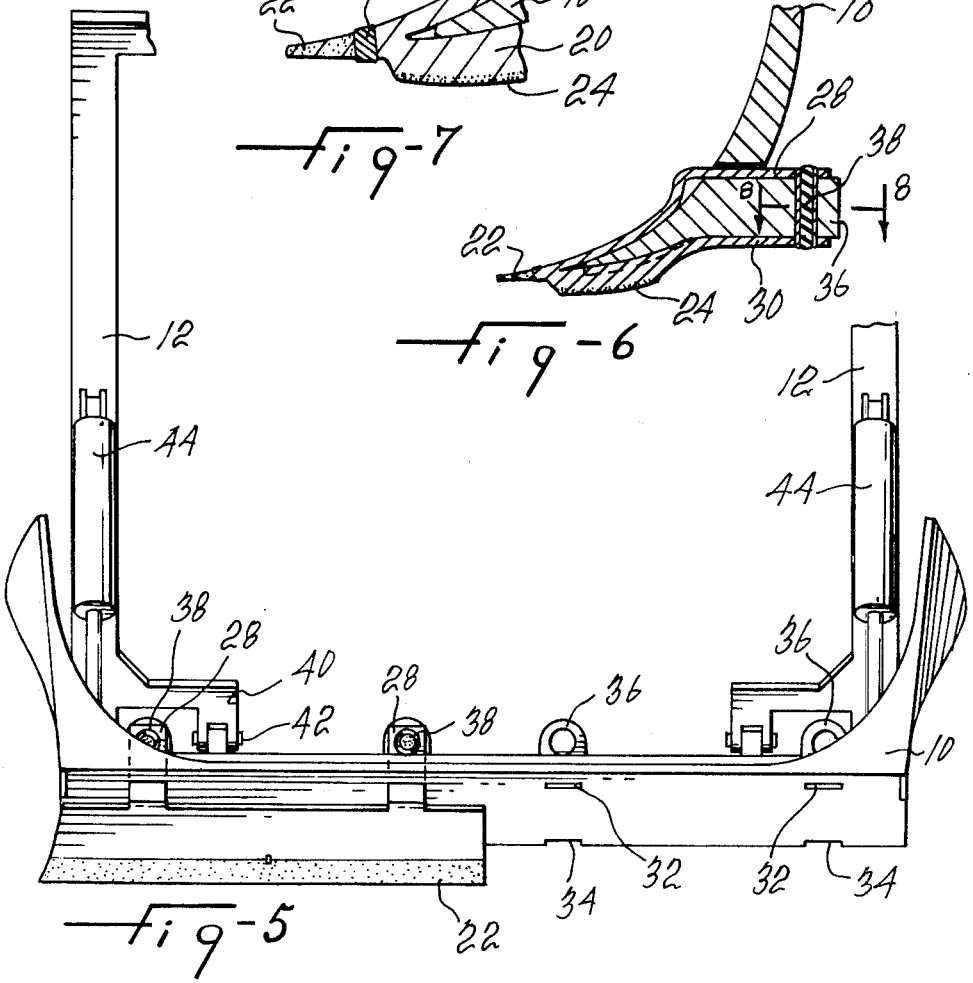
Fig-5

REPLACEABLE EDGE BIT ASSEMBLY

This invention relates to a replaceable edge bit assembly used for earth-working implements, such as blades or buckets.

It is commonly known to provide the blades or buckets of earth-working implements, such as road graders, bulldozers and bucket loaders, with replaceable wear-resistant members or bits, which are secured to the working edge of mold board of the implement. The known replaceable bits generally have a very short life under heavy duty conditions, such as normally encountered in rocky environments and, in addition, are not made to be reconditioned when worn out or damaged.

It is therefore the object of the present invention to provide a replaceable edge bit assembly which lasts substantially longer than the known bit and which, in addition, can be reconditioned to be re-used when worn out or damaged.

The replaceable bit assembly in accordance with the invention comprises a bit having a front portion adapted to engage the lower front edge of the mold board and a rear portion adapted to engage the lower rear edge of the mold board, a wear plate secured to the edge of the front portion of the bit, a skid shoe secured underneath the rear portion of the bit, and brackets for securing the bit to the mold board. A reference device may be secured to the wear plate to indicate the degree of wear of the wear plate.

Mounting blocks are normally secured to the lower rear edge of the mold board and the brackets extend through slots in the mold board and are secured to the mounting blocks.

The mold board is normally pivotally mounted in a frame attached to a tractor and hydraulic means are generally provided for adjusting the slope of the mold board. The use of a separate skid shoe, in accordance with the invention, permits to maintain the wear plate a predetermined distance above ground during use of the implement as a leveler, so as to prevent contact of the wear plate with heavy rocks sunk deep in the earth and thus damage the tractor under the resulting shocks.

The invention will now be disclosed, by way of example, with reference to a preferred embodiment illustrated in the accompanying drawings, in which:

FIG. 4 illustrates a front view of the earth-working implement shown in FIG. 1, one section of the bit being removed;

FIG. 5 illustrates a top view of the implement of FIG. 4;

FIG. 6 illustrates a cross-sectional view taken along line 6—6 of FIG. 4;

FIG. 7 illustrates a cross-sectional view taken along line 7—7 of FIG. 4; and FIG. 8 is a cross-sectional view taken along line 8—8 of FIG. 6.

Figure 1:
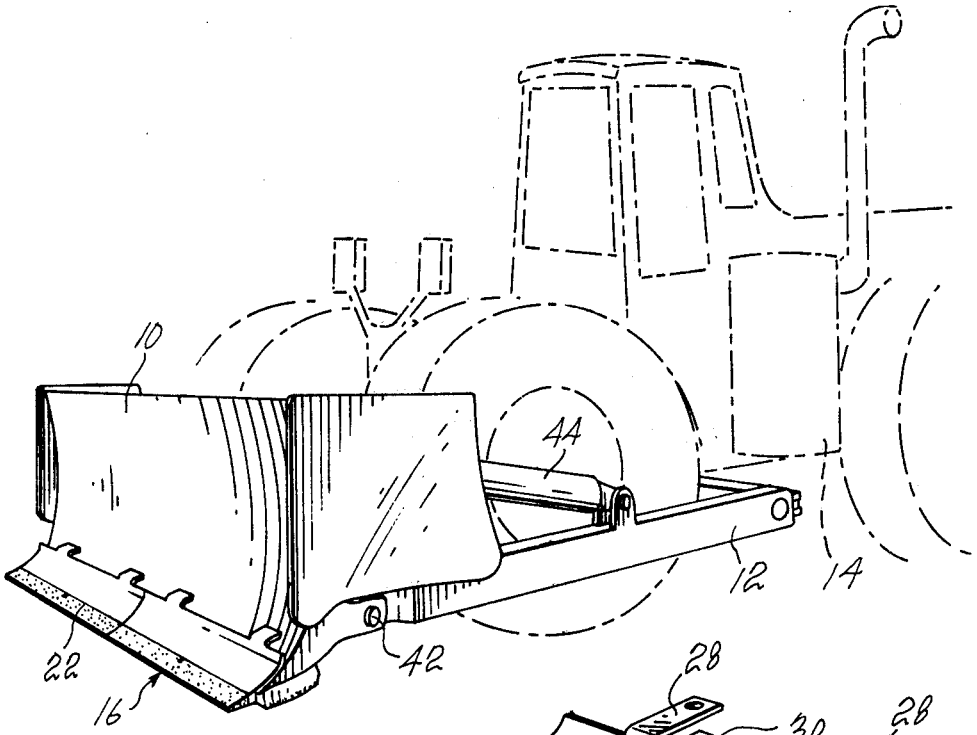
FIG. 1 illustrates a perspective view of an earth-working implement equipped with the replaceable bit assembly in accordance with the invention.
Figure 3:
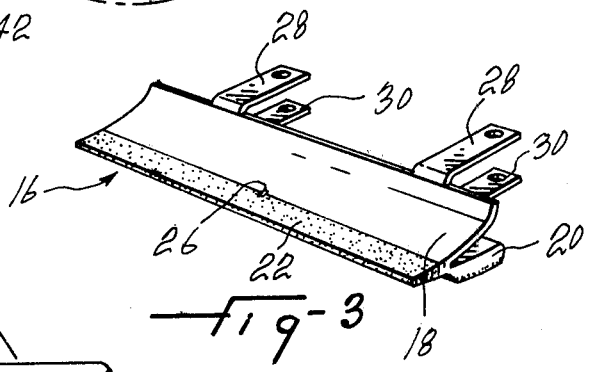
FIG. 3 illustrates a perspective view of the replaceable edge bit assembly in accordance with the invention.

Referring to the drawings, there is shown a blade type earth-working, or mold board implement 10, mounted on a frame 12 attached to a tractor 14. A plurality of replaceable edge bit assemblies 16 are secured to the blade mold board in a manner to be disclosed later. Each bit comprises a front portion 18 adapted to engage the lower front edge of the mold board and a rear portion 20 adapted to engage the lower rear edge of the mold board. The front and rear portions 18 and 20 are preferably made integral with each other, although they could possibly be made in two portions and secured together in any conventional way.

A wear plate 22, of wear-resistant material, is welded to the front edge of the bit assembly and a skid shoe 24, of wear-resistant material, is also welded to the rear portion of the bit assembly. The thickness of the skid shoe 24 is preferably such as to last about the same time as the wear plate 22 under normal operating conditions. The wear plate is also provided with a reference device 26, made of a material of different colors, such as synthetic diamond, to indicate when the bit should be replaced. Brackets 28 and 30 are welded to the front and rear portions 18 and 20, respectively, of the bit assembly.

As shown more clearly in FIGS. 4 and 5, brackets 28 and 30 are inserted into slots 32 and notches 34 in the mold board. A mounting block 36 is welded to the rear of the edge of the mold board and the bit assembly is secured to such mounting blocks by means of friction type headless pins 38, which may be made of compressible rubber partially enclosed by two transversely curved metal plates 38*a*.

The above arrangement permits to easily assemble and diassemble the bit assembly to the mold board by hammering the pins 38 from the top.

Figure 2:
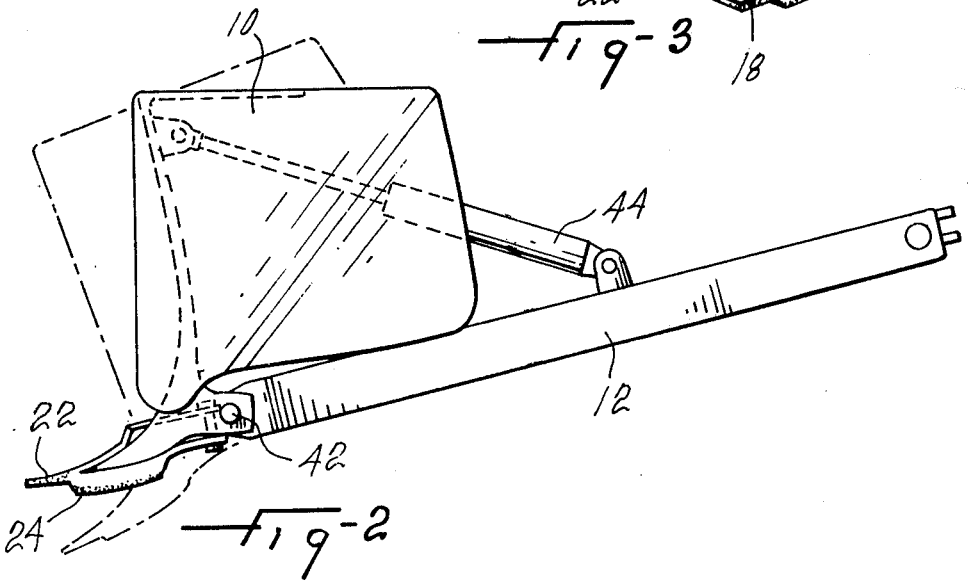
FIG. 2 illustrate a side view of the earth-working implement shown in FIG. 1.

As shown in FIGS. 1, 2, and 5, the blade 10 is pivotally mounted on frame 12 and frame extensions 40 by means of pins 42. A hydraulic cylinder 44 is attached to the frame 12 and has its piston connected to blade 10 to effect the required pivotal movement of the blade. There is one cylinder on each side of the frame and each cylinder can be operated separately from the hydraulic line of the tractor, so as to permit twisting of the blade, if required.

It is commonly known to pivot the blade of an earth-working implement. However, with the bit assembly in accordance with the present invention, the blade may be pivoted so that it is resting on the skid shoe 24 of the bit assembly during use of the implement as a leveler.

This way, wear plate 22 is kept a predetermined distance above ground to prevent its contact with heavy rocks sunk deep in the earth, which could heavily damage the tractor.

Another advantage of the bit assembly in accordance with the invention is that it may be reconditioned in the factory by soldering a new wear plate 22 and a new skid shoe 24 thereto. The reconditioning of both the wear plate and the skid shoe is preferably done at once, so as to save working time of the implement. This is why the thickness of the skid shoe 24 is designed such that it will wear out in aoubt the same time as the wear plate 22 under normal operating conditions of the implement.

Although the invention has been disclosed with reference to a preferred embodiment, it is to be understood that other alternatives are envisaged and that the invention is to be limited by the scope of the claims only. For example, other means may be used to secure the bit assembly to the blade. Also, other means may be utilized to pivot the implement on its frame.

What I claim is:

1. The combination of a replaceable edge bit assembly with a mold board of an earth-working implement, comprising:

(a) a mold board having a lower leading edge, a front surface, a back surface, a plurality of mounting blocks secured to and protruding rearwardly from said back surface, said blocks spaced longitudinally of said mold board and located substantially parallel to and rearwardly of said leading edge, each mounting block having a top face and a bottom face, said mold board further having as many slots as there are mounting blocks, extending through the molding board, and each opening at said back surface adjacent the top face of the associated mounting block;

(b) a replaceable edge bit having a leading edge, a front portion adapted to engage and overlie the lower front edge portion of the mold board and a rear portion adapted to engage and overlie the lower rear edge portion of said mold board, front and rear brackets secured to and extending rearwardly from the front portion and rear portion, respectively, of said edge bit, there being as many front and rear brackets as there are mounting blocks, said front brackets removably extending through said slots and engageable with the top faces of said mounting blocks, said rear brackets removably engaging the bottom faces of said mounting blocks, means for removably locking said front and rear brackets to said mounting blocks, said locking means being entirely disposed rearwardly of said mold board and edge bit; and (c) a skid shoe secured underneath the rear portion of said edge bit.

2. The combiantion as defined in claim 1, wherein said locking means consist of compressible locking pin meanss removably extedning within said blocks and through the ends of said front and rear brackets.

* * * * *